US009504329B2

(12) United States Patent
Adams, IV et al.

(10) Patent No.: US 9,504,329 B2
(45) Date of Patent: Nov. 29, 2016

(54) STACKABLE MOLDED PLASTIC ROCKING CHAIR

(71) Applicants: William E. Adams, IV, Zelienople, PA (US); Matthew Goodworth, Pittsburgh, PA (US)

(72) Inventors: William E. Adams, IV, Zelienople, PA (US); Matthew Goodworth, Pittsburgh, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 14/681,221

(22) Filed: Apr. 8, 2015

(65) Prior Publication Data

US 2016/0296019 A1 Oct. 13, 2016

(51) Int. Cl.

| | |
|---|---|
| ***A47C 3/02*** | (2006.01) |
| ***A47C 3/04*** | (2006.01) |
| ***A47C 3/12*** | (2006.01) |
| ***A47C 5/12*** | (2006.01) |
| ***A47C 3/029*** | (2006.01) |
| ***A47C 3/00*** | (2006.01) |

(52) U.S. Cl.

CPC ..... *A47C 3/029* (2013.01); *A47C 3/00* (2013.01); *A47C 3/04* (2013.01); *A47C 3/12* (2013.01); *A47C 5/12* (2013.01)

(58) Field of Classification Search

CPC ..... A47C 3/04; A47C 3/029; A47C 3/12; A47C 5/12

USPC ..... 297/239, 271.5, 271.6, 272.1, 272.2, 297/451.12, 452.65, DIG. 2

See application file for complete search history.

(56) References Cited

U.S. PATENT DOCUMENTS 232,147 A 9/1880 Reynolds
793,946 A * 7/1905 Miller ..... A47C 3/029 297/272.2
1,228,521 A 6/1917 Bell
1,682,685 A * 8/1928 Rodery ..... A47C 3/029 297/272.1
2,340,790 A 2/1944 Aylor
3,669,490 A * 6/1972 Bertolet ..... A47C 3/029 248/345.1
4,126,353 A * 11/1978 Clough ..... A47C 13/00 297/133
4,341,419 A 7/1982 Sebel
5,002,337 A 3/1991 Engel et al.
5,013,086 A * 5/1991 Benzur ..... A47D 9/02 297/133
5,660,431 A 8/1997 Leach et al.
5,702,152 A 12/1997 Shaw
5,833,307 A * 11/1998 Leach ..... A47C 3/029 297/133
5,839,781 A 11/1998 Knape
6,086,147 A 7/2000 Gladstone
6,398,297 B1 * 6/2002 Cantwell ..... A47C 4/286 297/133

(Continued)

FOREIGN PATENT DOCUMENTS

CA 2171371 A1 * 9/1997 ..... A47C 3/029

*Primary Examiner* — Ryan Kwiecinski

(74) *Attorney, Agent, or Firm* — Buchanan Ingersoll & Rooney PC

(57) ABSTRACT

A rocking chair has a seat, a back attached to the seat, a right rocker, at least one right leg connected to the seat and to the right rocker, a left rocker and at least one left leg connected to the seat and to the left rocker. The rockers each have a base having an inside edge and an outside edge the base having a slope such that when the rocking chair is placed on a flat surface a portion of the inside edge will be in contact with the flat surface and the outside edge will not be in contact will the flat surface. The rockers may alternatively or additionally each have an inwardly curving center portion. These features alone or in combination can prevent the rockers from splaying outward when a weight is dropped on the chair or while a person is rocking the chair.

18 Claims, 8 Drawing Sheets

(56) References Cited

U.S. PATENT DOCUMENTS

| | | | | |
|---|---|---|---|---|
| 6,416,123 | B1 | 7/2002 | Bell | |
| 7,401,854 | B2 | 7/2008 | Adams | |
| 8,070,229 | B2 | 12/2011 | Woodring | |
| 8,313,141 | B2 | 11/2012 | Woodring | |
| D688,885 | S | 9/2013 | Adams et al. | |
| D703,961 | S * | 5/2014 | Woodring | D6/348 |
| 8,960,792 | B1 | 2/2015 | Woodring | |
| D739,152 | S * | 9/2015 | Adams | D6/348 |
| 2010/0066139 | A1 * | 3/2010 | Woodring | A47C 3/029 297/239 |
| 2011/0148162 | A1 * | 6/2011 | Huang | A47C 3/029 297/271.6 |

* cited by examiner

STACKABLE MOLDED PLASTIC ROCKING CHAIR

FIELD OF THE INVENTION

The present invention relates to molded plastic chairs. More particularly, the present invention relates to a molded plastic rocking chair that nests or fits within an identical rocking chair when such chairs are vertically stacked.

BACKGROUND OF THE INVENTION

A wide variety of molded plastic chairs that stack one upon another are available in the marketplace. These prior art chairs have a seat, a back, front legs and rear legs directly connected to the seat, and usually have arms extending from the seat to the back. Each arm creates an opening bounded by that arm, the back and the seat. The legs extend outwardly from vertical to enable the chairs to be stacked one on top of another. In some stackable plastic chairs the rear legs of the uppermost chair extend through the openings bounded by the arms, back and seat of the chair below that chair in the stack. Stackable chairs have an advantage in that they can be stacked upon one another and placed on a pallet for easy transport. A retailer may display the stacked chairs on the same pallet on which they have been shipped. Consumers may also store several stackable chairs stacked one upon another. Plastic chairs are also advantageous because they are comfortable, inexpensive to manufacture, practical, lightweight, portable, water and weatherproof, sturdy, attractive, relatively easy to care for, and easy to move to and from a stacked arrangement.

U.S. Pat. Nos. 4,341,419 and 5,002,337 disclose examples of stackable side chairs. U.S. Pat. No. 7,401,854 discloses a stackable folding Adirondack chair. U.S. Pat. No. D688,885 discloses a stackable bar stool. All of these chairs have four legs with feet that rest on the floor or ground. For many years there has been a need for a stackable plastic rocking chair. Woodring in a series of related patents including U.S. Pat. Nos. 8,070,229, 8,313,141 and 8,960,792 discloses a monobloc rocking chair which is injection molded in one piece. He teaches that the side walls of the chair which includes the legs and the rockers must diverge outwardly from the top of the chair to the bottom so that the chairs can be stacked. Because of the outward divergence of the legs, the relatively small contact area between the floor and the rockers and the fact that the contact area changes as a person rocks in the chair, the rockers in the Woodring rocking chair can splay outwardly when a person sitting on the chair rocks back and forth. Continued rocking can cause the legs to break or cause the rockers to break away from the legs, breakage being more likely as the weight on the chair increases.

Plastic chairs for outdoor use must meet certain standard performance requirements. ASTM F 1561-03 standard sets forth specific tests to be performed in order to determine if a plastic chair meets those requirements. One test involves placing the chair on a glass surface which simulates smooth surfaces such as linoleum and wet pool decks. Three hundred pounds is placed on the chair. The chair must then hold for at least 30 minutes without failing. Failure occurs when the chair collapses or when any visible evidence of structural damage develops such as cracking. Chairs are often left up beyond 30 minutes to further evaluate performance even though that is not specified as necessary per the ASTM standard. Another test involves dropping a bag of shot onto the seat of the chair from a height of six inches above the seat. This test is conducted using a bag that weighs 150 pounds. The impact is repeated ten times. There must be no breakage or structural damage. The static load and impact tests are then repeated on plywood to simulate rougher surfaces such as textured concrete or treated lumber used on a deck. There are other tests required by the ASTM standard, but the tests described above are the core tests for that standard.

Retailers may require that other tests in addition to those outlined in the ASTM standard must be passed before they will sell a resin chair. The other tests may be derived from other standards that exist in the industry. BIFMA X5.1 requires that the chairs must pass one impact of 225 lbs. from six inches. Additional required tests may be "home-grown" where the retailer creates their own protocol such as one intended to simulate actual use. One example is a test where a rocking chair is loaded with weight such as used in a standard static load test and then rocked for a large number of cycles. Finally, there are test protocols for chairs intended to be marketed to large occupants. These chairs must withstand impacts of greater than 225 lbs.

Molded rocking chairs may be required to pass any or all of the tests described above, or other tests not described herein, to be deemed sufficient for retail distribution. It is unlikely that rocker like that illustrated in the Woodring patents will pass all of the required tests.

Consequently, there is a need for a stackable plastic rocking chair that will pass all of the tests that may be required for retail distribution.

SUMMARY OF THE INVENTION

We provide a rocking chair having a seat, a back attached to the seat, at least one right leg connected to the seat, at least one left leg connected to the seat, a right rocker attached to the right leg or legs and a left rocker attached to the left leg or legs. The rockers have a base having an inside edge and an outside edge. Preferably the base of each rocker has a slope such that when the rocking chair is placed on a flat surface a portion of the inside edge will be in contact with the flat surface and the outside edge will not be in contact will the flat surface.

We further prefer to construct the rockers so that they have a center portion which has an inward curvature. The center portion has an apex, a first end and a second end and the inward curvature is such that the apex of the curvature is displaced from the ends of the curvature by from 0.1 to 1.0 inch.

The rockers may be hollow having an inside side wall and an outside side wall and a base which is removably attached to either or both side walls. Preferably tabs are provided on the base which provides a snap fit between the base and the side walls. The tabs should be sized and positioned to enable the base to expand along its length when a weight is dropped onto the seat of the chair.

Other features and advantages of our stackable rocking chair will become apparent from certain present preferred embodiments thereof which are shown in the drawings.

DESCRIPTION OF THE PREFERRED EMBODIMENTS

Figure 1:
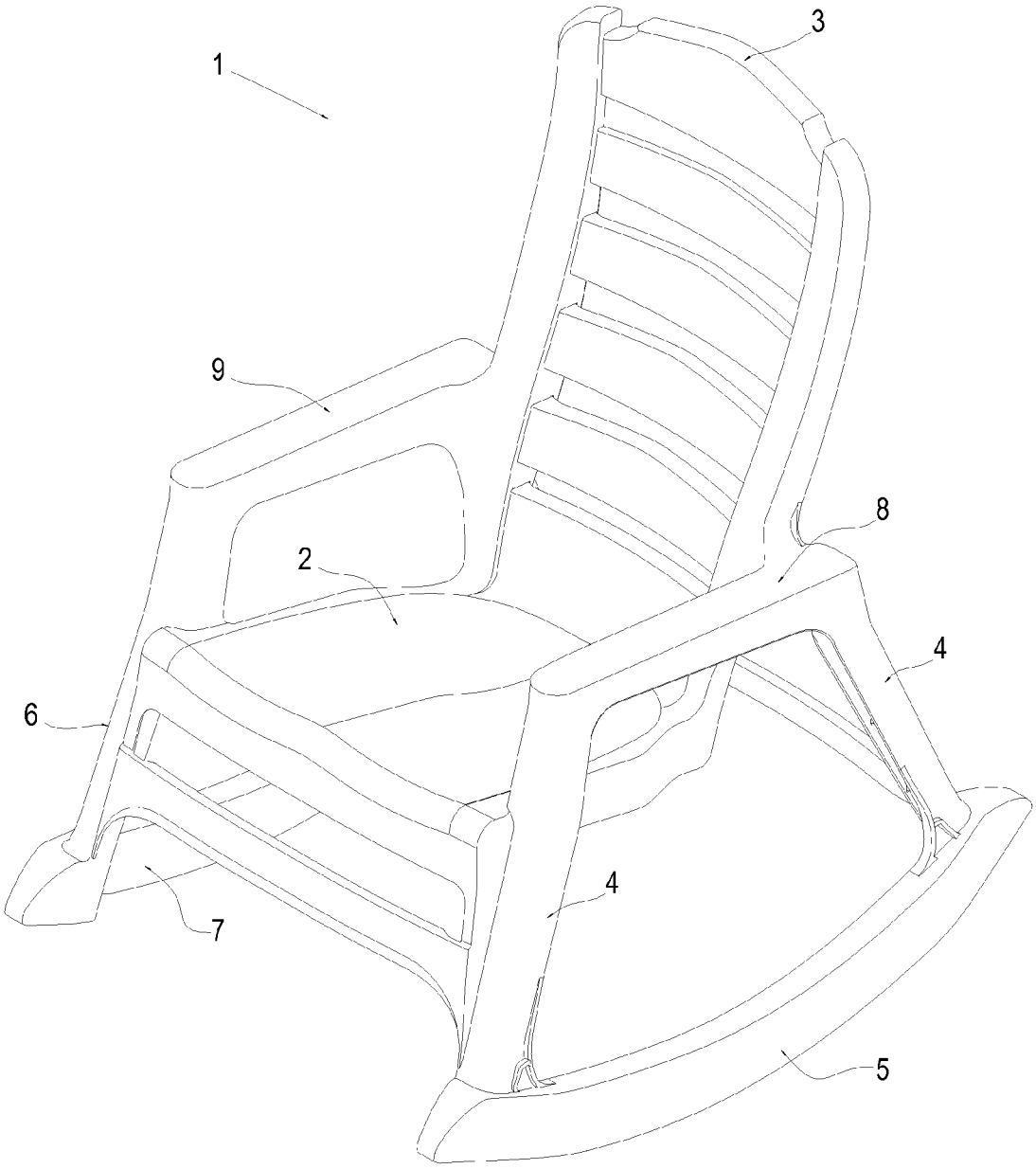
FIG. 1 is a perspective view of a present preferred embodiment of our stackable rocking chair.
Figure 2:
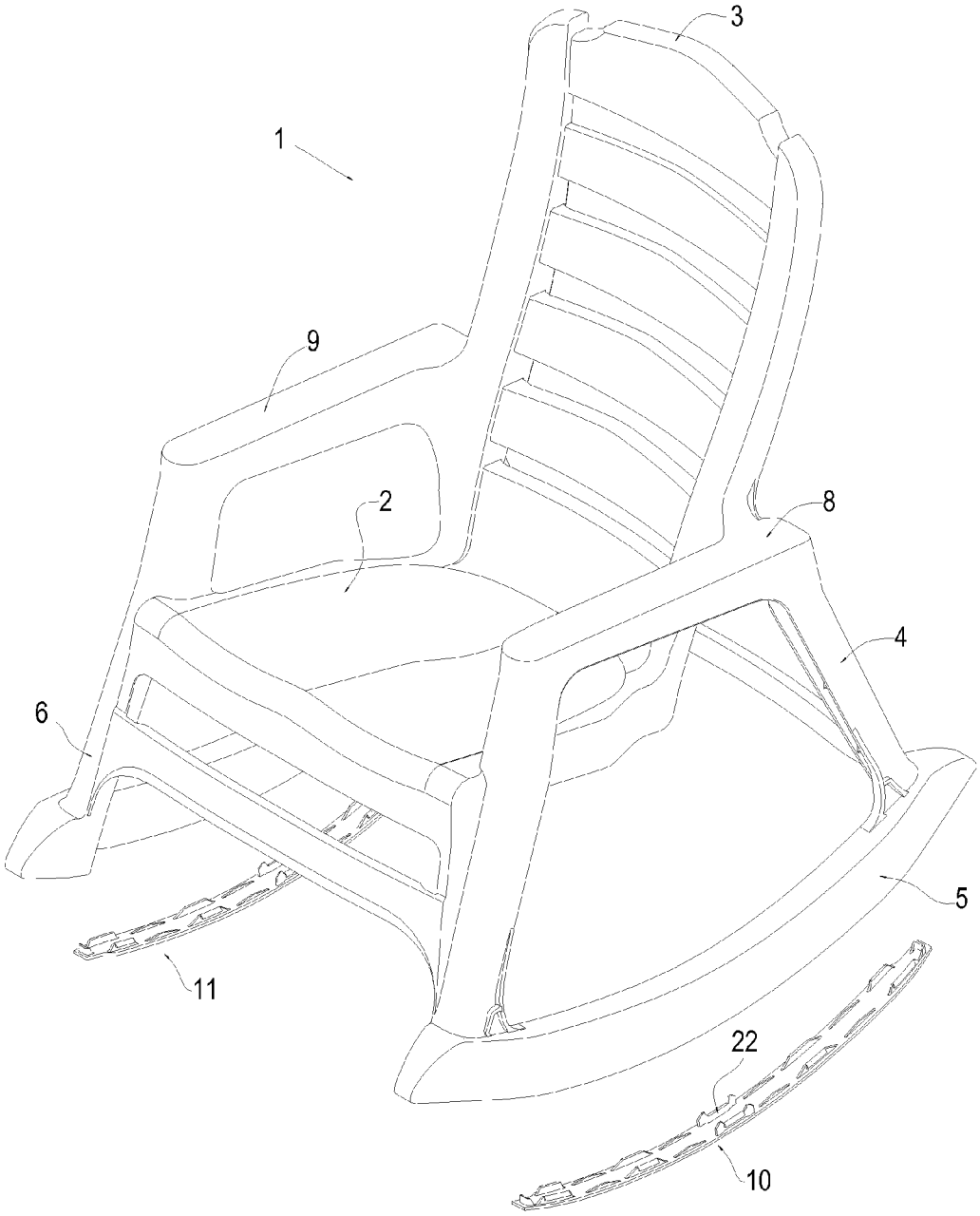
FIG. 2 is a perspective view similar to FIG. 1 in which the base of each rocker has been separated from the rocker.

Referring to FIGS. 1, 2, 5 and 6 a present preferred embodiment of our stackable rocking chair 1 has a seat 2 and back 3, two left legs 4, a left rocker 5, connected to the left legs, two right legs 6 and a right rocker 7 connected to the right legs. A left arm 8 is connected to the left rear leg and a right arm 9 is connected to the right rear leg. Both arms are connected to the back 3 of the chair at points above the seat 2. This connection in which the rear legs extend above the seat provides greater stability, particularly while the chair is being rocked. A similar arm and leg configuration could be used on chairs without rockers. The arms, legs and rockers are constructed so that they extend outwardly with the distance between the outer edges of arms 8 and 9 being less than the distance between the inner edges of the rockers 5 and 7. In a present preferred embodiment the distance between the outside edges of the arms is about 25 inches while the distance between the inside edges of the rockers is about 31 inches. This shape enables one rocking chair to be stacked on another rocking chair for shipment and storage.

Figure 7:
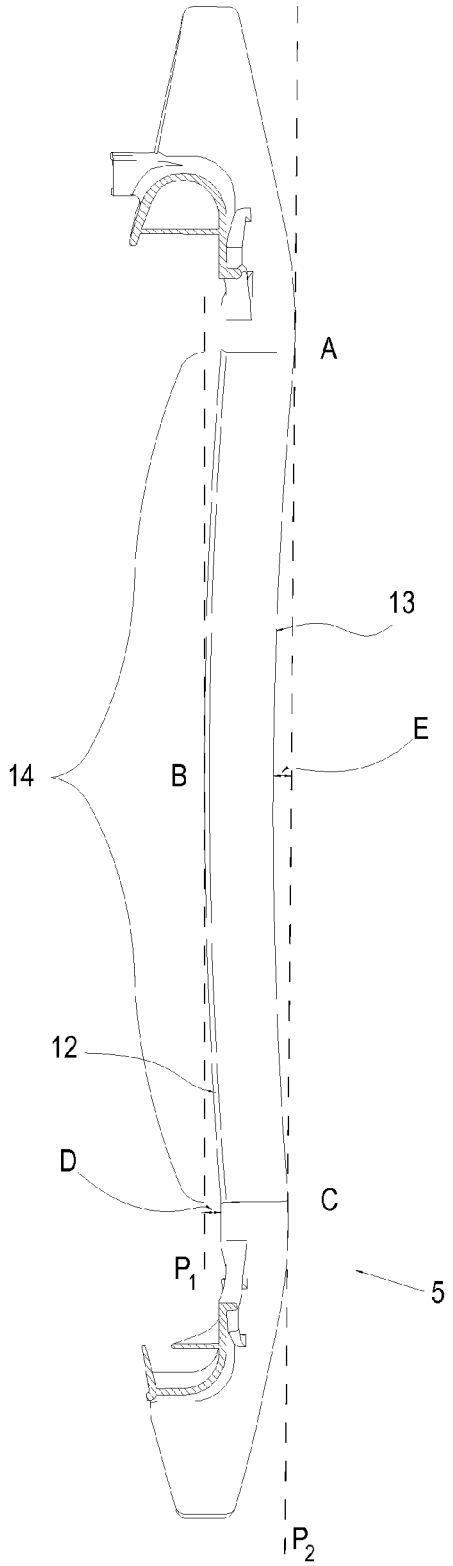
FIG. 7 is a sectional view taken along the line VII-VII in FIG. 6.
Figure 8:
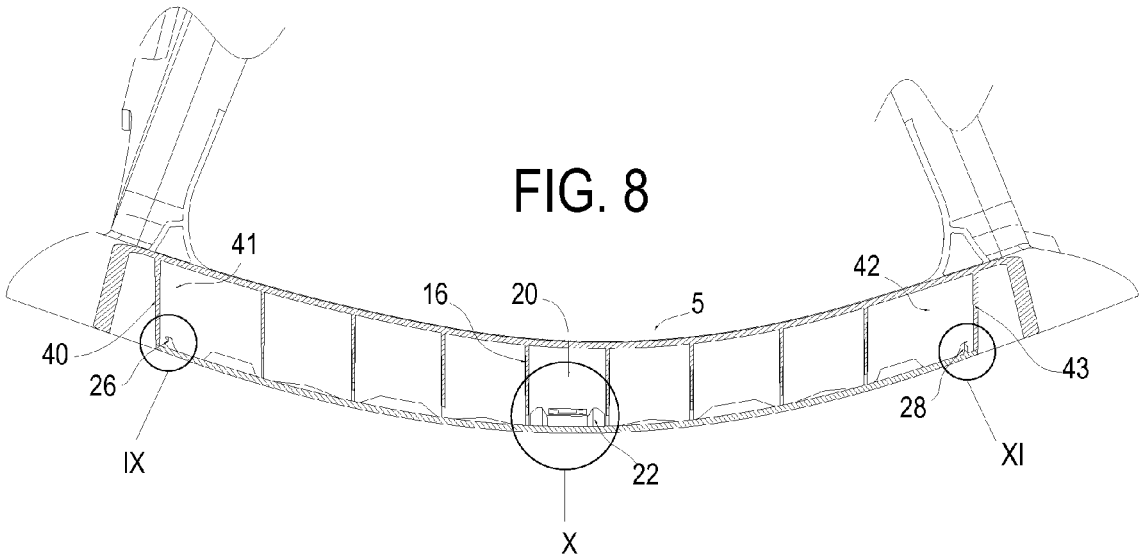
FIG. 8 is a sectional view taken along the line VIII-VIII in FIG. 5.
Figure 9:
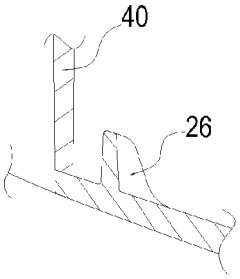
FIG. 9 is an enlarged view of a portion of the rocker within circle IX in FIG. 8.
Figure 10:
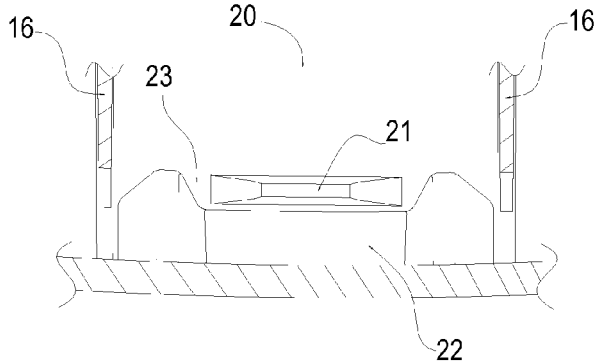
FIG. 10 is an enlarged view of a portion of the rocker within circle X in FIG. 8.
Figure 11:
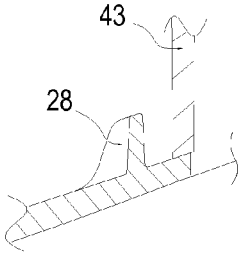
FIG. 11 is an enlarged view of a portion of the rocker within circle XI in FIG. 8.

We prefer to provide a removable base 10, 11 on each of the rockers 5, 6. As seen most clearly in FIGS. 7 and 8, the rockers preferably are hollow and have an inside wall 12 and an outside wall 13. The rockers have a center portion 14 which is curved inward. Parallel reference lines $P_1$ and $P_2$ are provided in FIG. 7 so that the curvature can be more easily seen and described. The center portion has an apex B, a first end A and a second end C. Line $P_2$ passes through the ends A and C of the curved portion. The apex B of the curvature is displaced from the ends A and C of the curved portion by a distance E. That distance preferably is from 0.125 to 0.16 inches and may be from between 0.1 to 1.0 inches. There will be a similar displacement between the ends of the curved portion and the line $P_2$ as indicated by arrow D. The displacements D and E need not be exactly the same. The effect of the curved portion is to move the inside edge of the rocker and the area where the rocker contacts the floor inward. During impact from a weight hitting the seat or while a person is sitting on the chair the downward forces will be concentrated on the rockers. Most often those forces will occur near the center of the rocker. Curving the rockers inward moves the force vector toward the center of the chair creating a force vector that is vertical or near vertical. A vertical or near vertical force will not cause the rockers to splay outward.

We further prefer to provide tabs 22 on the top surface of each rocker base that enable the base to snap fit onto the rocker. The tabs may be configured to mate with ribs or slots (not shown) on the inside surface of the inside wall and the inside surface of the outside wall of the rocker. When a downward force acts on the rockers, the removable bases and the side walls of the rockers expand along their length. Because the base fits over the side walls, the base has a larger effective radius than the side walls. Consequently, upon impact the base expands more than the side walls expand. For the base to stay within the channel between the side walls of the rocker the base must have clearance to expand at each end. To keep the clearance intact so the base cannot bottom out at one end, the center of the base must be held securely. As shown in FIGS. 8 through 11 there are ribs 16 on the inside surface of the inside wall and on the inside surface of the outside wall to strengthen these walls. The ribs create pockets between adjacent ribs. We prefer to position the ribs to create a center pocket 20 and provide a horizontal projection 21 on the side wall within that pocket. A pair of center tabs 22 is provided on the base 10, 11. The center tabs engage ribs or slots in the inside surface of the rocker side walls to securely attach the center of the base to the center of the rocker such that the base will not come off of the rocker during normal use. Each center tab 22 is somewhat smaller in width than the center pocket 20. Consequently there will be a clearance on either side of the center tab 22 when the center tab 22 is in the center pocket 20 and the chair is at a rest position. The rest position is the position of the chair when no person is seated in the chair and the chair is not being rocked. We prefer that this clearance be at least 0.05 inches. We also prefer to provide a recess 23 on the top of the center tab which receives the horizontal projection 21. The tabs 26 and 28 on the ends of the base fit within the front end pocket 41 bounded by rib 40 or within the rear end pocket 42 bounded by rib 43. These tabs 26, 28 have a width that is less than the width of the pocket 41, 42 into which they are inserted. The relative dimensions of the tab width and the width of the pocket should permit the base to travel toward the front of the rocker and travel toward the rear of the rocker as the base expands under impact. We prefer to provide approximately 0.2 inches of travel clearance between the tab 26 or 28 and the rib 40 or 43. Without this clearance the ends of the base would pop off of the rocker when a weight is dropped on the seat of the chair or while the chair is being rocked.

Figure 3:
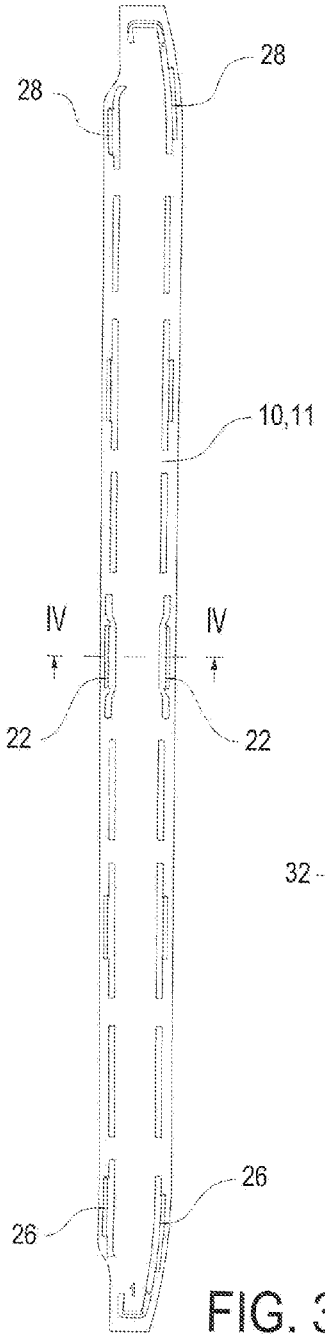
FIG. 3 is a top view of a present preferred embodiment of the rocker base.
Figure 4:
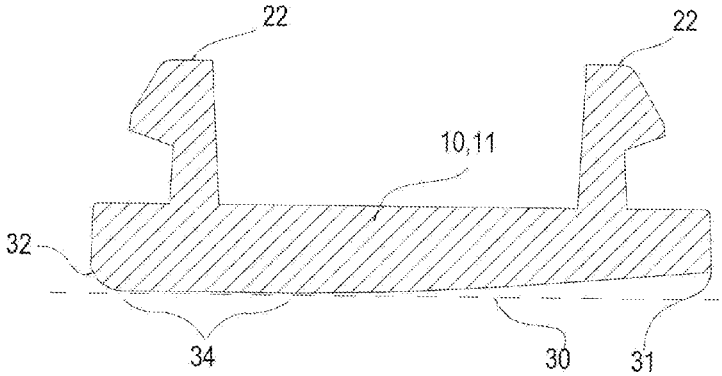
FIG. 4 is a sectional view taken along the line IV-IV in FIG. 3.
Figure 5:
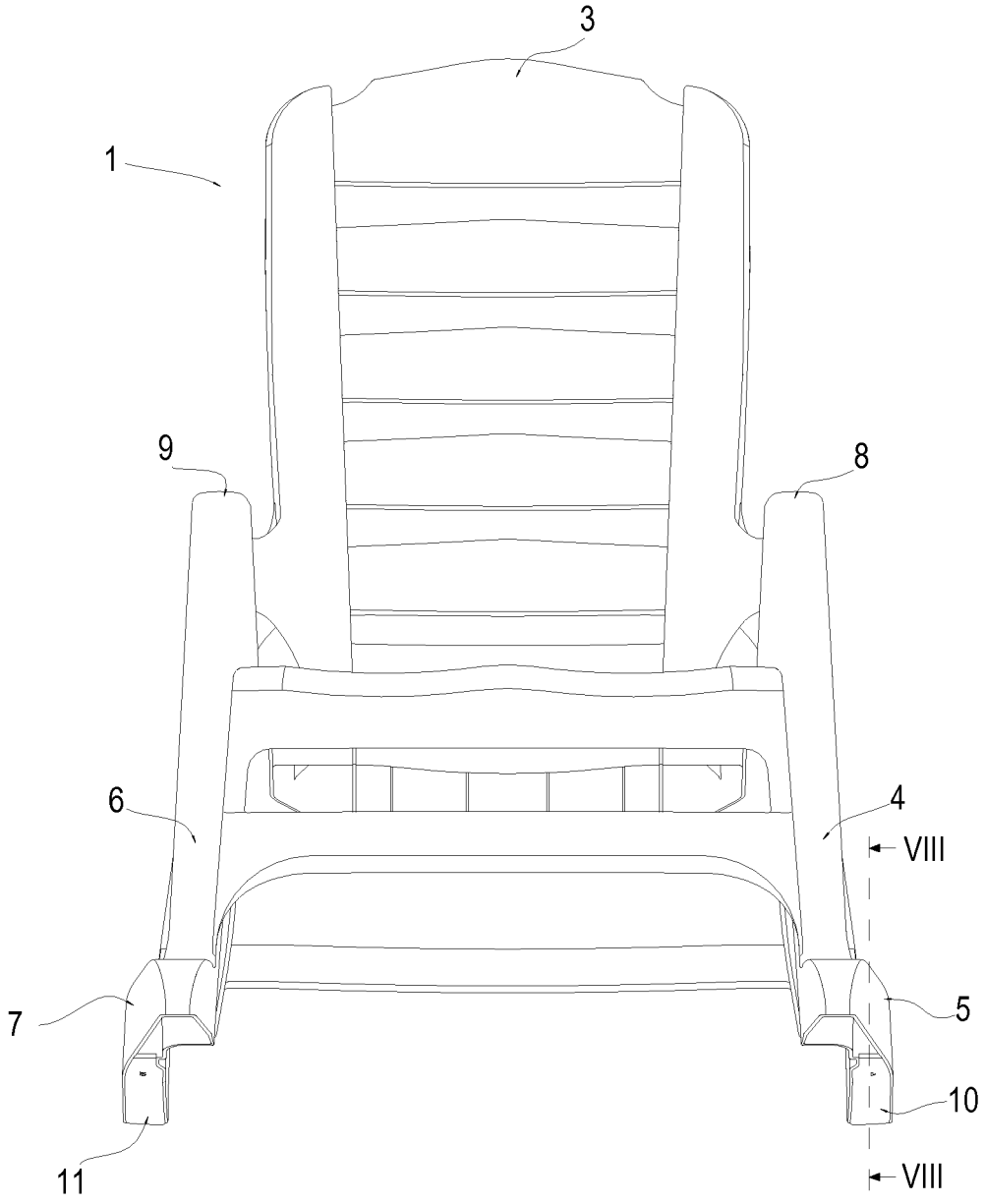
FIG. 5 is a front view of the stackable rocking chair shown in FIGS. 1 and 2.
Figure 6:
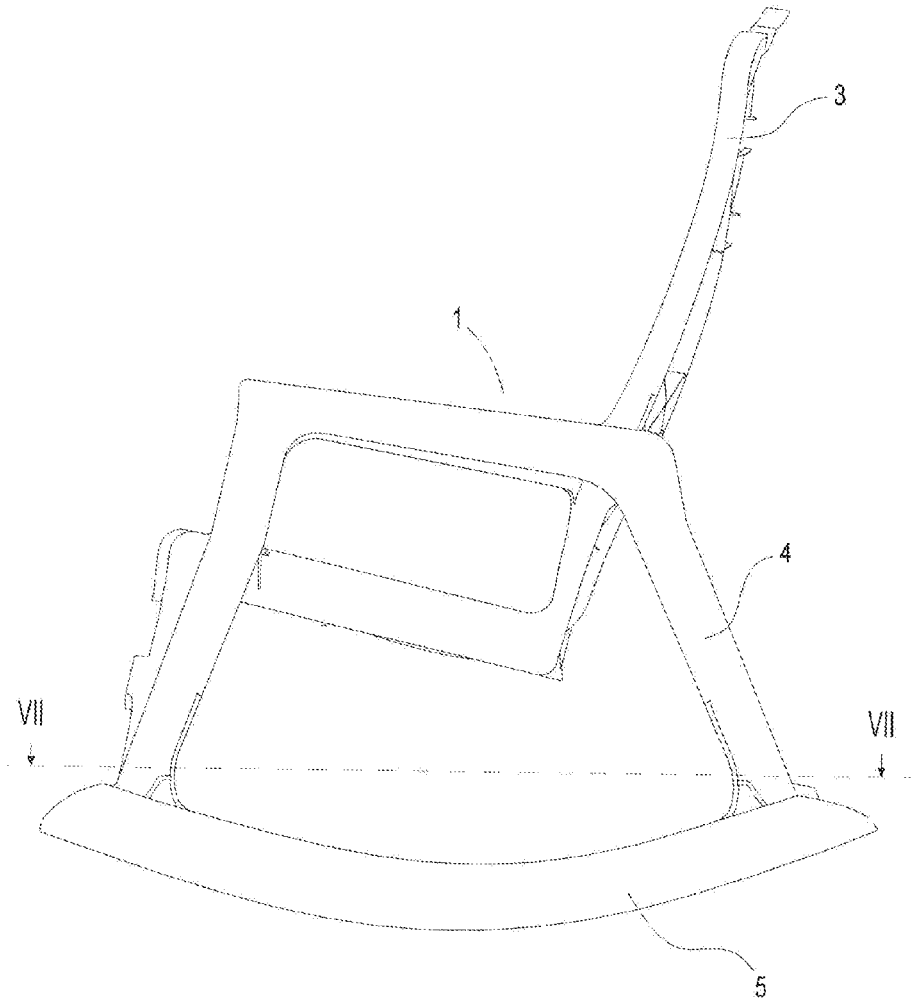
FIG. 6 is a left side view of the stackable rocking chair shown in FIGS. 1 and 2.

We further prefer that the base of each rocker be sloped so that when the rocking chair is placed on a flat surface a portion of the inside edge and a portion of the base adjacent that portion of the inside edge will be in contact with the flat surface while the outside edge will not be in contact will the flat surface. In a present preferred embodiment, shown in FIGS. 3 and 4, the base 10, 11 sits on a flat surface 30 such as the floor of a room, deck or patio. The base 10, 11 has an outside edge 31 and an inside edge 32. The base is sloped such that the inside edge 32 and a portion of the base adjacent the inside edge 34 rest on the floor 30 while the outside edge 31 and a portion of the base adjacent the outside edge is raised up from the floor. When a weight is placed on the chair the downward force caused by that weight will be concentrated along the inside edge where the base is in contact with the floor. The force vector associated with that force will be vertical or near vertical. A vertical or near vertical force will not cause the rockers to splay outward. The region 34 of the base that is in contact with the floor may have a width of up to about 0.4 inches. If the region of contact between the base and the floor encompassed the entire region between the inside edge and the outside edge then the outside edge might contact the floor first. This could occur if the outside edge of the wall is lower than the inside edge due to manufacturing variances or due to the surface on which the rocker is placed being uneven. If the outside edge of the wall is lower, then the downward force vector would be at an angle relative to vertical. That angle typically will be at least five degrees. While that angle may seem small it still may result in a significant outward force on the rockers, causing them to splay out in the center.

We created a prototype first rocking chair similar to that shown in the drawings although we did not curve the center portion of the rockers inward. The rockers were straight. We tested the chair by dropping a 150 lb. bag of shot five inches onto the seat. This is not as high as the standard test height, but as it was a prototype chair we did not want to use full force. Even with the drop height being lower than is standard, during impact at least one rocker broke off where it meets the front leg. This illustrated the potential outward force vector and resulting outward torque which can act upon the rockers if their center portion is not curved inward. This force seems travels frontward and rearward from the contact point of the rocker with the floor to around where the rockers meet the legs, increasing the stress around those locations to the point of seeing breakage.

We modified one of the rocker bases on a second rocking chair, a molded chair very similar to that shown in the drawings, to eliminate the slope on that rocker base and make it convex on the bottom like the rockers in conventional rocking chairs. The region of contact between this rocker base and the floor was along the centerline of the rocker between the rocker's inside edge and outside edge. The other base was left alone with a sloped bottom so that contact with the floor would be channeled to the inside region of the base. We observed that an adult male weighing about 190 lbs. rocking in the chair caused the rocker with the modified base (i.e. the one with the roughly flat bottom) to splay outward in the center. The rocker with the non-modified base (i.e. the one with slope) did not exhibit any outward splay. During several cycles of rocking, the rocker with the modified convex base seemed to work its way outward out a little more each cycle until it was significantly outwardly deformed in the center while the rocker with the non-modified base exhibited no outward splay.

We tested a third rocking chair, a molded chair very similar to that shown in the drawings. The chair incorporated rockers with inwardly curving center sections and bases with sloped bottoms to promote inside edge contact with the floor. This chair passed ten 225 lb. drops on both glass and wood. This chair also endured static load testing of over one hour holding 525 lbs. with no outward splay in the rockers. Another rocking chair with the same inwardly curved rockers with sloped bottoms passed one 350 lb. drop from six inches.

We concluded that both the inward curvature of the rockers and the slope on the base of the rockers enabled the chair to pass the tests described above with no breakage around where the rockers meet the legs and no outward splay in the center of the rockers. Depending upon the dimensions of the chair and of the rockers a stackable rocking chair having only the inwardly curved rockers could pass these same tests. Similarly, there may be stackable rocking chairs of some dimensions having straight rockers and a sloped bottom surface on the base of each rocker that will pass these tests.

Figure 12:
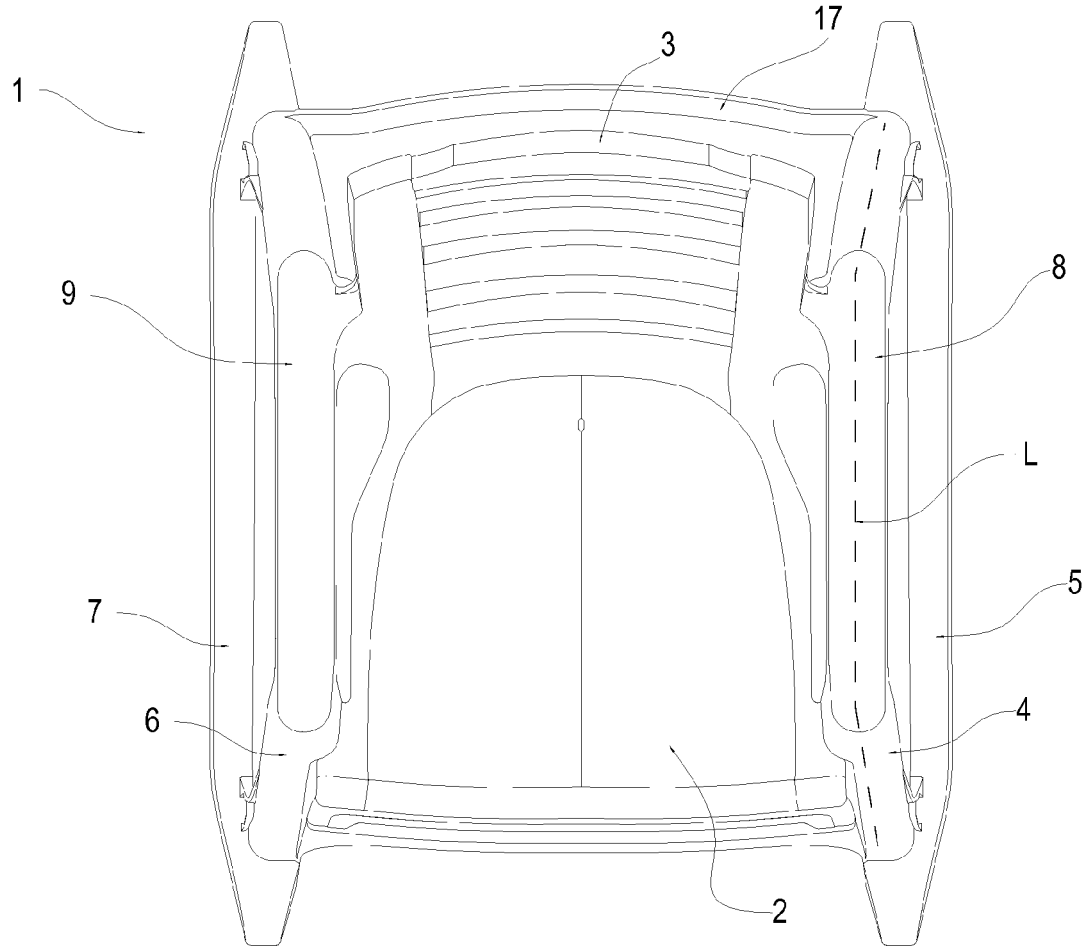
FIG. 12 is a top view of the stackable rocking chair shown in FIGS. 1 and 2.

Another important feature of our rocking chair can be seen most clearly in FIG. 12. The legs 4 and 6 extend outward from the arms 8 and 9 in two directions. The lateral outward extension is indicated by the U-shaped broken line L. The rear legs extend rearward and the front legs extend forward from the ends of the arms 8, 9. There is a rearwardly curved cross-brace 17 between the rockers near to or rearward of the junction of the rear legs with the rockers. The brace may be connected between the legs. As can be seen in FIG. 12, the back 3 of the chair is inward of the rear cross-brace 17 and the arms 8, 9. This configuration enables the rocking chairs to be stacked one upon another. The curved brace allows the rear of the rockers and the rear legs to flex under load.

In the embodiment shown in the drawings the rockers are hollow having a top, two side walls and a removable base. Other configurations of the rocker could be used including using an open top or providing an open side wall. One could also provide a solid rocker, but using a solid rocker on a molded plastic rocking chair will significantly increase the time required for the chair to cure and increase the cycle time. The cycle time required to produce a molded plastic chair having solid rockers may be commercially unacceptable.

We prefer to make our chair from calcium-filled polypropylene. Talc-filled polypropylene as well as polypropylene without a filler or with other fillers may also be used.

Although we have shown and described certain present preferred embodiments of our stackable rocking chair it should be distinctly understood that our invention is not limited thereto but may be variously embodied within the scope of the following claims.

We claim:

1. A rocking chair comprised of a seat, a back attached to the seat, at least one right leg connected to the seat, at least one left leg connected to the seat, a right rocker connected to the at least one right leg and a left rocker connect to the at least one left leg, wherein the right rocker has a base having an inside edge and an outside edge the base having a slope such that when the rocking chair is placed on a flat surface a portion of the inside edge will be in contact with the flat surface and the outside edge will not be in contact with the flat surface; and wherein the left rocker has a base having an inside edge and an outside edge adjacent the base, the base having a slope such that when the rocking chair is placed on a flat surface a portion of the inside edge will be in contact with the flat surface and the outside edge will not be in contact with the flat surface; and wherein the right rocker has a center portion which has a curvature that curves inward toward the left rocker; and wherein the left rocker has a center portion which has a curvature that curves inward toward the right rocker.

2. The rocking chair of claim 1 wherein the center portion of at least one of the left rocker and the right rocker has an apex, a first end and a second end and the inward curvature is such that the apex of the curvature is displaced from the ends of the center portion by from 0.1 to 1.0 inches.

3. The rocking chair of claim 2 wherein the apex of the curvature is displaced from the ends of the center portion by from 0.14 to 0.16 inches.

4. The rocking chair of claim 1 wherein the right rocker has an inside side wall and an outside side wall and the base of the right rocker is removably attached to at least one of the inside side wall and the outside side wall of the right rocker and wherein the left rocker has an inside side wall and an outside side wall and the base of the left rocker is removably attached to at least one of the inside side wall and the outside side wall of the left rocker.

5. The rocking chair of claim 4 wherein there is a snap fit between the base of the right rocker and at least one of the inside side wall and the outside sidewall of the right rocker and there is a snap fit between the base of the left rocker and at least one of the inside side wall and the outside sidewall of the left rocker.

6. The rocking chair of claim 1 wherein the rocking chair is plastic.

7. The rocking chair of claim 6 wherein the plastic is polypropylene, calcium filled polypropylene or talc filled polypropylene.

8. The rocking chair of claim 1 wherein the at least one right leg is comprised of a front right leg and a rear right leg, the rear right leg having a lower end attached to the right rocker and upper end, and the at least one left leg is comprised of a front left leg and a rear left leg, the rear left leg having a lower end attached to the left rocker and an upper end, the rocking chair further comprising a right arm attached to the upper end of the rear right leg, the right arm attached to the back at a point above the seat; and a left arm attached to the upper end of the rear left leg, the left arm attached to the back at another point above the seat.

9. A rocking chair comprised of a seat, a back attached to the seat, at least one right leg connected to the seat, at least one left leg connected to the seat, a right rocker connected to the at least one right leg and a left rocker connect to the at least one left leg, wherein the right rocker has a base having an inside edge and an outside edge, the base having a slope such that when the rocking chair is placed on a flat surface a portion of the inside edge will be in contact with the flat surface and the outside edge will not be in contact with the flat surface; and wherein the left rocker has a base having an inside edge and an outside edge adjacent the base, the base having a slope such that when the rocking chair is placed on a flat surface a portion of the inside edge will be in contact with the flat surface and the outside edge will not be in contact with the flat surface; and wherein each rocker has a center pocket, a front end pocket and a rear end pocket and the base of each rocker further comprising a center tab which is within the center pocket of the rocker and is sized an configured to secure the base at a center of the base to the rocker while enabling the base to expand upon impact, a front end tab which is within the front end pocket of the rocker and is sized and configured to attach the front end of the base to the rocker and enable the base to expand upon impact and a rear end tab which is within the rear end pocket of the rocker and is sized and configured to attach the rear end of the base to the rocker and enable the base to expand upon impact.

10. A rocking chair comprised of a seat, a back attached to the seat, at least one right leg connected to the seat, at least one left leg connected to the seat, a right rocker connected to the at least one right leg and a left rocker connected to the at least one left leg, wherein the right rocker has an inner edge and a center portion which has a curvature that curves inward toward the left rocker; and wherein the left rocker has an inner edge and a center portion which has a curvature that curves inward toward the right rocker.

11. The rocking chair of claim 10 wherein each center portion has an apex, a first end and a second end and the inward curvature is such that the apex of the curvature is displaced from the ends of the curvature by from 0.1 to 1.0 inches.

12. The rocking chair of claim 11 wherein the apex of the curvature is displaced from the ends of the center portion by from 0.14 to 0.16 inches.

13. The rocking chair of claim 10 wherein the right rocker has a base, an inside side wall and an outside side wall and the base of the right rocker is removably attached to at least one of the inside side wall and the outside side wall of the right rocker and wherein the left rocker has a base, an inside side wall and an outside side wall and the base of the left rocker is removably attached to at least one of the inside side wall and the outside side wall of the left rocker.

14. The rocking chair of claim 13 wherein there is a snap fit between the base of the right rocker and at least one of the inside side wall and the outside side wall of the right rocker and there is a snap fit between the base of the left rocker and at least one of the inside side wall and the outside side wall of the left rocker.

15. The rocking chair of claim 10 wherein the rocking chair is plastic.

16. The rocking chair of claim 15 wherein the plastic is polypropylene, calcium filled polypropylene or talc filled polypropylene.

17. The rocking chair of claim 10 wherein the at least one right leg is comprised of a front right leg and a rear right leg, the rear right leg having a lower end attached to the right rocker and upper end, and the at least one left leg is comprised of a front left leg and a rear left leg, the rear left leg having a lower end attached to the left rocker and an upper end, the rocking chair further comprising a right arm attached to the upper end of the rear right leg, the right arm attached to the back at a point above the seat; and a left arm attached to the upper end of the rear left leg, the left arm attached to the back at another point above the seat.

18. A rocking chair comprised of a seat, a back attached to the seat, at least one right leg connected to the seat, at least one left leg connected to the seat, a right rocker connected to the at least one right leg and a left rocker connected to the at least one left leg, wherein each rocker has a center pocket, a front end pocket and a rear end pocket, and further comprises a detachable base, and the base of each rocker further comprising a center tab which is within the center pocket of the rocker and is sized and configured to secure the base at a center of the base to the rocker while enabling the base to expand upon impact, a front end tab which is within the front end pocket of the rocker and is sized and configured to attach the front end of the base to the rocker and enable the base to expand upon impact and a rear end tab which is within the rear end pocket of the rocker and is sized and configured to attach the rear end of the base to the rocker and enable the base to expand upon impact.

* * * * *